US009688523B2

(12) United States Patent
Kamakura et al.

(10) Patent No.: US 9,688,523 B2
(45) Date of Patent: Jun. 27, 2017

(54) CAP OPENING TOOL SET AND CAP OPENER

(75) Inventors: Takayuki Kamakura, Shinagawa-ku (JP); Shinichi Nomura, Shinagawa-ku (JP); Osamu Nakagiri, Takatsuki (JP); Hiromitsu Nakashima, Minato-ku (JP)

(73) Assignee: UCC Ueshima Coffee Co., Ltd., Kobe-shi (JP)

( * ) Notice: Subject to any disclaimer, the term of this patent is extended or adjusted under 35 U.S.C. 154(b) by 594 days.

(21) Appl. No.: 14/343,671

(22) PCT Filed: Sep. 9, 2011

(86) PCT No.: PCT/JP2011/070602

§ 371 (c)(1), (2), (4) Date: Mar. 7, 2014

(87) PCT Pub. No.: WO2013/035195

PCT Pub. Date: Mar. 14, 2013

(65) Prior Publication Data

US 2014/0224071 A1 Aug. 14, 2014

(51) Int. Cl.

*B67B 7/18* (2006.01)
*B67B 7/14* (2006.01)

(Continued)

(52) U.S. Cl.

CPC ..... *B67B 7/18* (2013.01); *B67B 7/14* (2013.01); *B67B 7/20* (2013.01); *B67B 7/24* (2013.01); *B67B 7/44* (2013.01)

(58) Field of Classification Search

CPC .... B67B 7/24; B67B 7/14; B67B 7/18; B67B 7/44

(Continued)

(56) References Cited

U.S. PATENT DOCUMENTS 1,337,899 A * 4/1920 Girard ..... B67B 7/18 81/3.36
1,383,112 A * 6/1921 Hanson ..... B67B 7/18 81/3.43

(Continued)

FOREIGN PATENT DOCUMENTS

JP 10-29697 A 2/1998
JP 3069857 U 7/2000

(Continued)

OTHER PUBLICATIONS

International Search Report dated Nov. 29, 2011 with English translation (three (3) pages).

*Primary Examiner* — Bryan R Muller
(74) *Attorney, Agent, or Firm* — Crowell & Moring LLP

(57) ABSTRACT

It is an objective of the present invention to provide a cap opening tool set that enables the user of a container to reduce surely an inner pressure of the container and loosen smoothly a screw cap even if the user has only a weak arm power. A cap opening tool set according to the present invention includes a ring and a cap opener. The ring includes a guide section for facing a circumferential surface section of a screw cap. The cap opener includes a head to be placed over the screw cap and arms extending from the head. The head includes a contact section, a top-surface facing section, and a needle. The contact section enters a space formed between the screw cap and the guide section and presses the circumferential surface section of the screw cap. The needle penetrates the top surface section of the screw cap.

5 Claims, 8 Drawing Sheets

(51) Int. Cl.

| | |
|---|---|
| ***B67B 7/04*** | (2006.01) |
| ***B67B 7/20*** | (2006.01) |
| ***B67B 7/00*** | (2006.01) |
| ***B67B 7/44*** | (2006.01) |

(58) Field of Classification Search
USPC ..... 81/3.29, 3.43, 3.48, 3.49; 215/302, 303, 215/219
See application file for complete search history.

(56) References Cited

U.S. PATENT DOCUMENTS 1,712,987 A * 5/1929 Forster ..... B67B 7/30 30/439
2,535,783 A * 12/1950 Churchill ..... B67B 7/28 222/183
2,571,590 A * 10/1951 Logic ..... B67B 7/28 222/86
2,717,708 A * 9/1955 Martinez ..... B65D 50/06 215/219
2,735,318 A * 2/1956 Hrebicek ..... B67B 7/18 81/3.07
2,749,784 A * 6/1956 Hrebicek ..... B67B 7/18 81/3.42
2006/0236552 A1* 10/2006 Giles ..... B26F 1/32 30/366
2010/0078404 A1 4/2010 Barange et al.

FOREIGN PATENT DOCUMENTS

JP 2001-158500 A 6/2001
JP 2003-155099 A 5/2003
JP 2007-30971 A 2/2007
JP 2009-241944 A 10/2009
JP 2011-102149 A 5/2011

* cited by examiner

CAP OPENING TOOL SET AND CAP OPENER

TECHNICAL FIELD

The present invention relates to a cap opening tool set for use in opening a screw cap and to a cap opener.

BACKGROUND ART

Roasted coffee beans release carbon dioxide gas by nature, so that if the roasted coffee beans are filled in a container for storage, the released carbon dioxide gas raises the inner pressure of the container, which in some cases causes deformation of the container or the like. Thus, it is necessary to fill the roasted coffee beans into the container after the carbon dioxide gas release rate is lowered or to use a container equipped with a venting mechanism in order to suppress a rise in the inner pressure of the container. In such cases, however, the aroma components of the coffee beans will be released together with the carbon dioxide gas, so that the more carbon dioxide gas is released, the less impressive the flavor of the coffee becomes.

Patent Document 1 discloses a coffee bean container incorporated with a lid that can solve the above problem. Where the pressure balance of carbon dioxide gas released from roasted coffee beans is 0.25-0.35 MPa, the container of Patent Document 1 is designed to withstand an inner pressure greater than 0.25-0.35 MPa, and therefore the container does not deform even if filled with roasted coffee beans and sealed tightly, and once the inner pressure of the container has reached 0.25-0.35 MPa, release of the carbon dioxide gas and the aroma ingredients from the container can be suppressed.

By the way, the container of Patent Document 1 has a mouth section (an opening portion) sealed with a screw cap. This screw cap is firmly screwed onto the mouth section of the container for tight sealing, so that a consumer of the coffee beans (a user of the container) needs a relatively strong grasping power or arm power to loosen the screw cap. If cap openers disclosed in Patent Documents 2 and 3 are used, even a user with a weak arm power can open the cap. However, there is a risk that if the user loosens the screw cap of the container when the inner pressure is higher than the outside pressure, the contents might blow out.

CONVENTIONAL ART DOCUMENTS

Patent Documents

Patent Document 1: Japanese Unexamined Patent Application Publication No. 2009-241944

Patent Document 2: Japanese Unexamined Patent Application Publication No. 2003-155099

Patent Document 3: Japanese Unexamined Patent Application Publication No. 2001-158500

SUMMARY OF THE INVENTION

Objective to be Achieved by the Invention

The present invention has been made in view of the above problem, and it is an objective of the present invention to provide a cap opening tool set and a cap opener that ensure a user of a container to reduce the inner pressure of the container and that enable even a user with a weak arm power to loosen a screw cap.

Means of Achieving the Objective

A cap opening tool set according to the present invention that solves the above problem is a cap opening tool set for use in removing a screw cap tightened on a mouth section of a container, the cap opening tool set comprising:

a ring constructed to be fitted on the container or on the screw cap;

a cap opener constructed to apply a rotation torque to the screw cap, the ring having a guide section for facing a circumferential surface section of the screw cap, the cap opener including a head and an arm, the head constructed to be placed over the screw cap, the arm extending from the head, the head including a contact section, a top-surface facing section, and a needle, the contact section constructed to enter a space formed between the screw cap and the guide section, the top-surface facing section constructed to face a top surface section of the screw cap, the needle disposed at the top-surface facing section, the contact section constructed to engage or press the circumferential surface section of the screw cap, the needle constructed to penetrate the top surface section of the screw cap.

According to the present invention, the user of the container only needs to penetrate the needle through the top surface section of the screw cap to reduce the inner pressure of the container. Further, the contact section enters the void formed between the guide section of the ring and the screw cap, which makes it difficult for the head to drop off from the screw cap and also assists the user in pushing the needle through the top surface section of the screw cap safely and smoothly. Then, when the user operates to engage or press the contact section on the circumferential surface section of the screw cap and after that, rotates the arms, a rotation torque is applied to the screw cap via the contact section. Because the location at which the rotation torque is applied is distant from the screw cap, even a small force enables the screw cap to be loosened smoothly. Also, the guide section of the ring provided around the screw cap and facing the screw cap makes it impossible to grasp the screw cap well by any other means (such as another tool or a human hand) than the cap opener and thus to apply a great rotation torque to the screw cap. As a result, the user abandons opening the container forcibly by any other means (such as another tool or a human hand) than the cap opener. Namely, the ring serves as an obstacle to block the container from being opened by any other means than the cap opener.

Preferably, the ring has an extension section extending inward in a radial direction thereof, the extension section constructed to engage the container or the screw cap. With this construction, the ring hardly drops off from the container or from the screw cap.

Preferably, the cap opener has a hooking portion constructed to be latched and held on an outer circumference of the ring. With this construction, the ring that becomes out of use is easy to remove. The ability of the ring to be removed from the container improves ease of use of the container after the container is opened, and also makes the container, after use, more adapted to sorting and collection of waste, which leads to a contribution to effective utilization of resources (recycle and reuse).

A first cap opener according to the present invention that solves the above problem is a cap opener for applying a rotation torque to a screw cap tightened on a mouth section of a container, the cap opener comprising:

a head constructed to be placed over the screw cap;

an arm extending from the head, the head including a contact section, a top-surface facing section, and a needle, the contact section constructed to engage or press a circumferential surface section of the screw cap, the top-surface facing section constructed to face a top surface section of the screw cap, the needle disposed at the top-surface facing section, the needle constructed to penetrate the top surface section of the screw cap.

A second cap opener according to the present invention that solves the above problem is a cap opener for applying a rotation torque to a screw cap tightened on a mouth section of a container, the cap opener comprising:

a head constructed to be placed over the screw cap;

a pair of arms extending from the head, the head including: a frame section C-shaped when viewed from above: a contact section supported on the frame section; a top-surface facing section constructed to face a top surface section of the screw cap; and a needle disposed at the top-surface facing section, one of the arms being joined to one end portion of the frame section, the other arm being joined to the other end portion of the frame section, the frame section constructed to reduce a diameter thereof as the arms are brought closer to each other, the contact section constructed to be pressed against a circumferential surface section of the screw cap when the diameter of the frame section is reduced, the needle constructed to penetrate the top surface section of the screw cap.

According to the cap openers of the present invention, all required to reduce the inner pressure of the container is only to penetrate the needle through the top surface section of the screw cap. Also, since the location at which the rotation torque is applied to the screw cap is distant from the screw cap, even a small force enables the screw cap to be loosened smoothly. Further, according to the second cap opener, only by closing the pair of arms together, the contact section is pressed on the circumferential surface section of the screw cap, which facilitates operations in loosing the screw cap.

Effect of the Invention

According to the present invention, the user of the container can reduce the inner pressure of the container surely and even a user with weak arm power can loosen the screw cap smoothly.

EMBODIMENT FOR CARRYING OUT THE INVENTION

Figure 1:
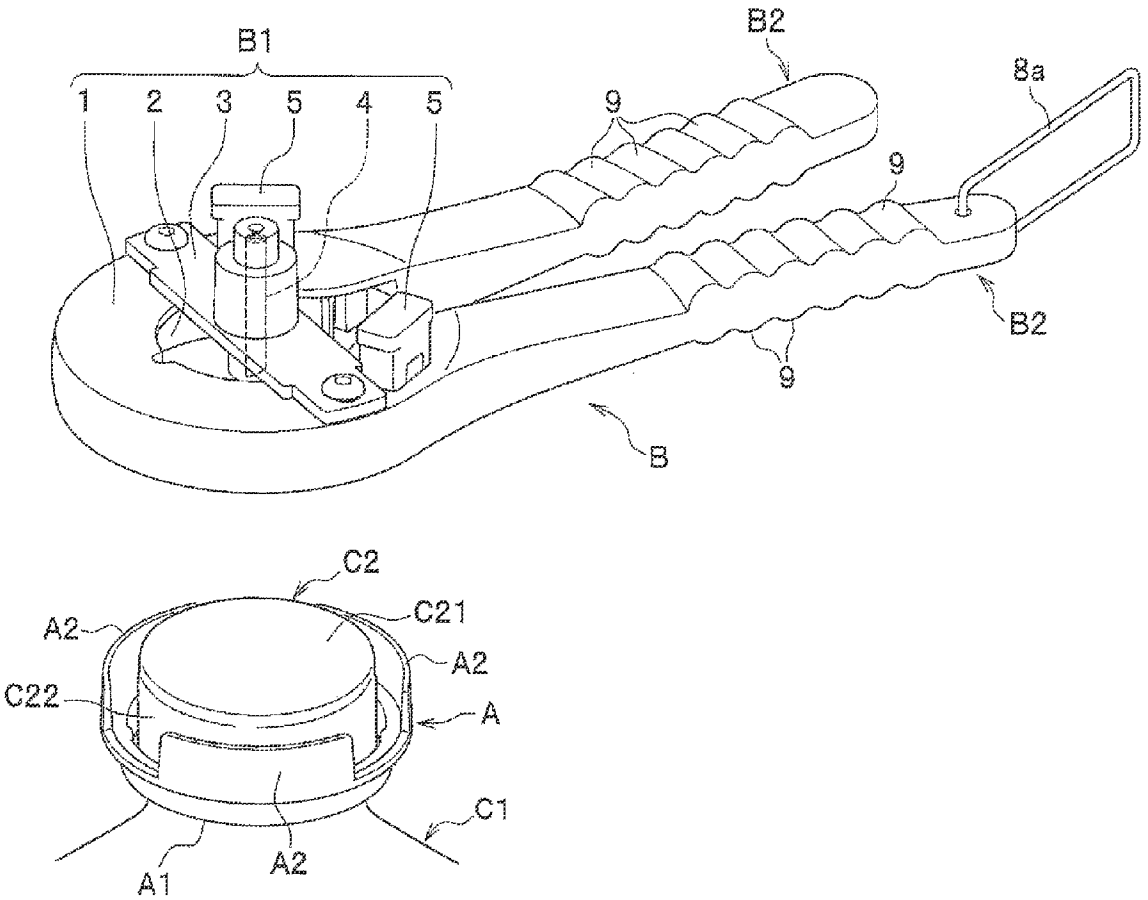
FIG. 1 is perspective view of a cap opening tool set according to an embodiment of the present invention.

As shown in FIG. 1, a cap opening tool set according to an embodiment of the present invention are for use in removing a screw cap C2. The cap opening tool set includes a ring A fitted on a container C1 and a cap opener B constructed to apply a rotation torque to the screw cap C2.

<Container and Screw Cap>

The container C1 and the screw cap C2, each made of an aluminum alloy, are formed to withstand an inner pressure of 0.35 MPa or more. The container C1 is filled with roasted coffee beans, from which a carbon dioxide gas is released to cause the inner pressure of the container C1 sometimes to reach 0.25-0.35 MPa.

The container C1 has a cylindrically shaped mouth section with threads formed on an outer circumferential surface thereof. The screw cap C2, sealing the container C1, has a lidded cylindrical shape. The screw cap C2 includes a disk-shaped top surface section C21 and a cylindrical circumferential surface section C22 formed around the edge of the top surface section C21. The circumferential surface section C22 has threads formed in an inner circumferential surface thereof. The screw cap C2 is tightened onto the mouth section of the container C1 after coffee beans are filled into the container C1.

<Ring>

The ring A acts as an obstacle for blocking the cap from being opened by any other means (such as another tool or a human hand) than the cap opener B. The ring A is fitted onto the mouth section of the container C1 in the roasting factory. The ring A is rotatable relative to the mouth section of the container C1 as well as to the screw cap C2. Accordingly, if the user rotates the ring A, the rotation torque has no effect on the screw cap C2. Note that the containers C1 are distributed to consumers through markets, with coffee beans filled therein and the rings A fitted on the mouth sections thereof.

Figure 2A:
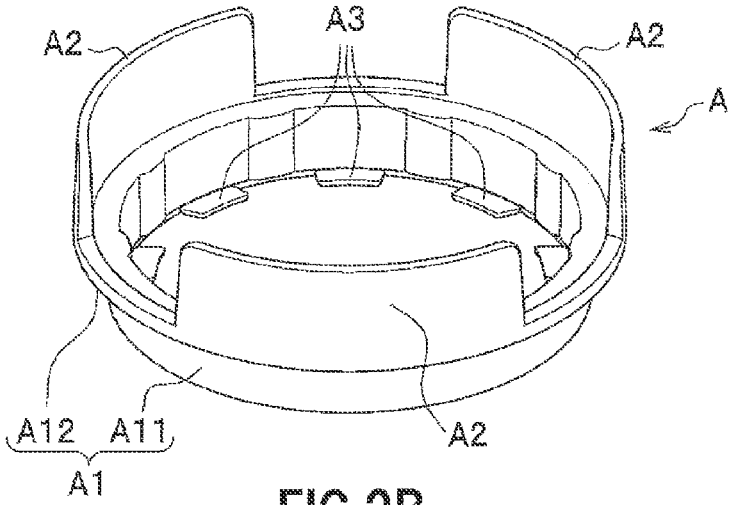
FIG. 2A is a perspective view of a ring.

As shown in FIG. 2A, the ring A includes a ring main body A1; a plurality of guide sections A2, A2, A2 extending upright from the ring main body A1; and a plurality of extension sections A3, A3, . . . extending from the ring main body A1 inward in the radial direction thereof. The ring A is made of a synthetic resin.

Figure 2B:
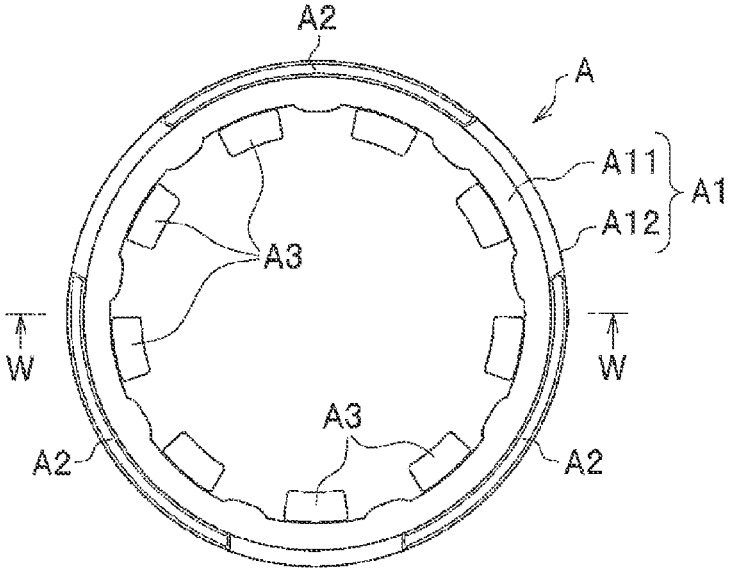
FIG. 2B is a top view of the ring.
Figure 6A:
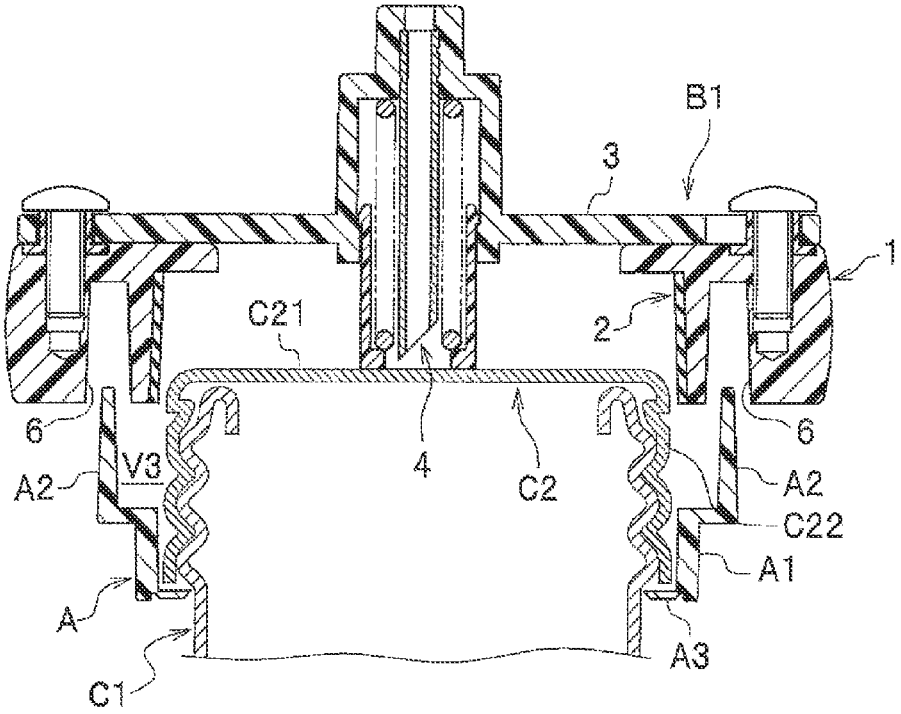
FIGS. 6A and 6B are cross sectional views for explaining a process of removing a screw cap, FIG. 6A illustrating the head placed on the screw cap, FIG. 6B illustrating a needle penetrating a top surface section of the screw cap.

As shown in FIG. 2B, the ring main body A1 includes a cylindrical portion A11 and a flange A12 extending from the upper edge of the cylindrical portion A11. The flange A12 extends outward from the outer circumferential surface of the cylindrical portion A11. As shown in FIG. 6A, the ring main body A1 has an inner diameter greater than the outer diameter of the screw cap C2. The ring main body A1 has an inner circumferential surface facing a lower half portion of the circumferential surface section C22 of the screw cap C2.

Figure 2C:
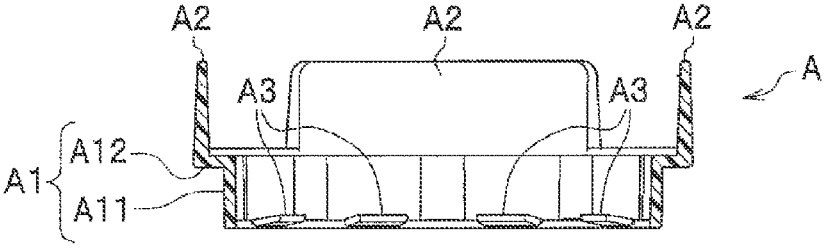
FIG. 2C is a cross sectional view taken along line W-W of FIG. 2B.

As shown in FIG. 2A, the guide sections A2, A2, A2, each having a curved-plate shape, are arranged at intervals from each other in the circumferential direction of the ring main body A1. As shown in FIG. 2B, the guide sections A2, A2, A2 are arranged along the outer circumference of the flange A12. When viewed from above, each guide section A2 is arc shaped. As shown in FIG. 2C, each guide section A2 extends upward from the upper surface of the flange A12 approximately perpendicularly thereto. When viewed from its front, each guide section A2 is rectangular in shape. As shown in FIG. 6A, each guide section A2 is located away from the circumferential surface section C22 of the screw cap C2. The inner circumferential surface of the guide section A2 faces an upper half portion of the circumferential surface section C22.

As shown in FIG. 2A, each extension section A3 protrudes like a cantilever from the inner circumferential surface at the lower edge of the cylindrical portion A11. The extension sections A3 are flat and, when viewed from above, rectangular in shape as shown in FIG. 2B. The extension sections A3, A3, A3 are spaced apart along the circumferential direction of the cylindrical portion A11. As shown in FIG. 6A, the tips of the extension sections A3 are in contact with or proximate the root of the mouth section of the container C1, and when the ring A is about to slip out of the mouth section during transport or the like of the container C1, engages a thread of the container C1 or the lower edge of the screw cap C2. Thus, providing the extension sections A3 makes it difficult for the ring A to come off, preventing abrupt drop off of the ring A. Note that in a case where, although not illustrated, a flange or a step is formed on the mouth section of the container C2, the tips of the extension sections A3 may be constructed to engage such a flange or the like.

<Cap Opener>

As shown in FIG. 1, the cap opener B includes a head B1 to be placed over the screw cap C2 and a pair of arms B2, B2 extending from the head B1. The cap opener B has a function of reducing the inner pressure of the container C1, a function of applying a rotation torque to the screw cap C2, and a function of assisting in removing the ring A.

Figure 4:
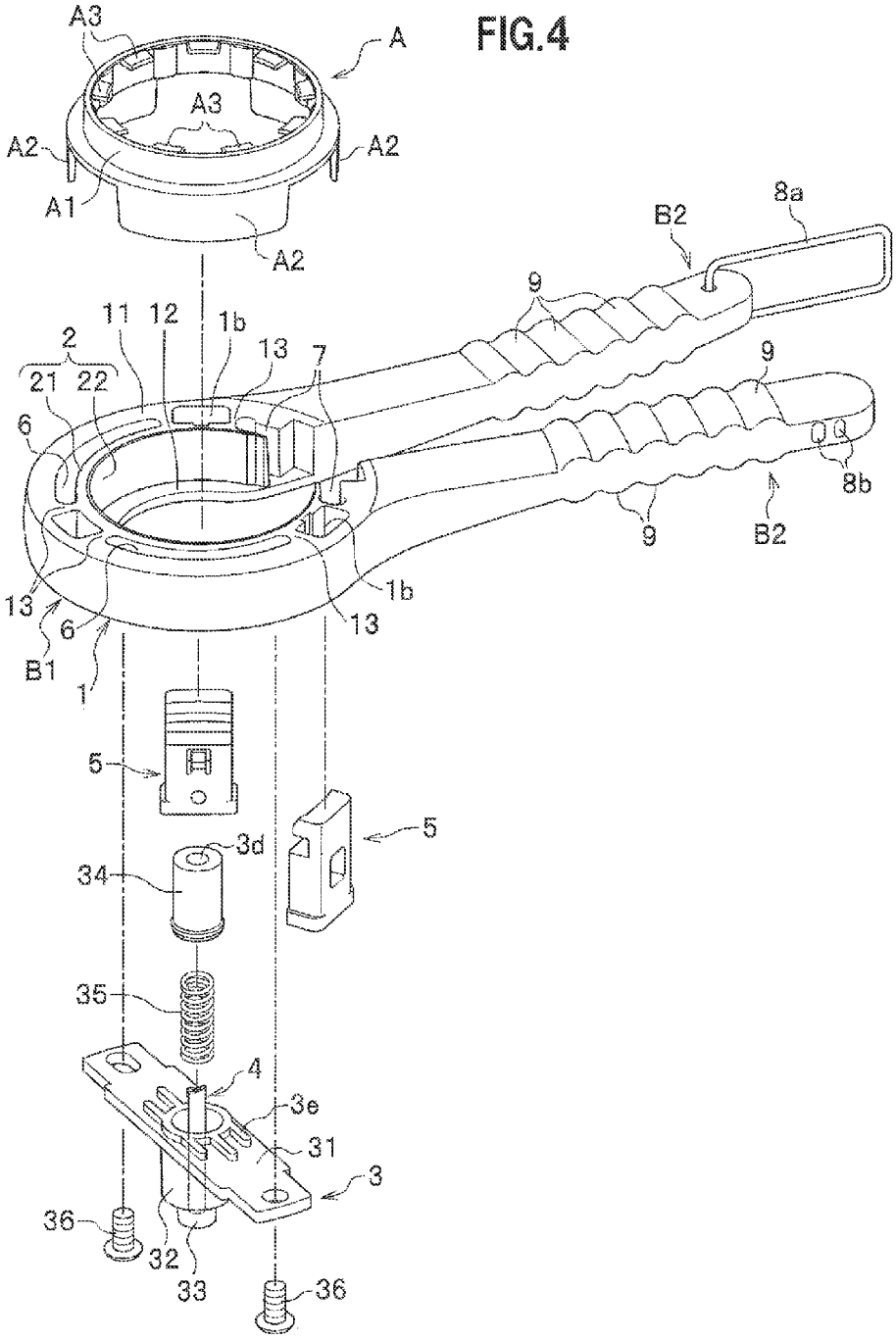
FIG. 4 is a perspective view of the cap opener and the ring according to the embodiment of the present invention, turned upside down.

The head B1 has a frame section 1 which in a plan view is C-shaped; a contact section 2 to be pressed against the circumferential surface section C22 of the screw cap C2; a top-surface facing section 3 to face the top surface section C21 of the screw cap C2; a needle 4 to penetrate the top surface section C21; and hooking portions 5 to be latched and held on the outer circumference of the ring A. Further, as shown in FIG. 4, at the lower surface of the head B1 are first guide trenches 6, 6 and second guide trenches 7, 7, for the guide sections A2 of the ring A to be inserted in.

The arms B2, B2 are arranged side by side with a gap provided therebetween. A first arm B2 is joined to a first end portion of the frame section 1 and a second arm B2 is joined to a second end portion of the frame section 1. In other words, each arm B2 extends like a cantilever from the frame section 1. A lock member 8*a* which has a shape of a rectangular frame is attached to an end of the first arm B2, whereas projections 8*b*, 8*b* for latching and holding the lock member 8*a* are formed on a lateral surface at an end of the second arm B2. Further, a plurality of ridges 9, 9, . . . serving as a cleat are formed in parallel to each other on upper and lower surfaces at portions of the arms B2 that serve as handgrips (holds).

The distance between the arms B2, B2 decreases progressively toward the frame section 1 to be minimized at base end portions (portions adjoining to the frame section 1) of the arms B2, B2. When the arms B2, B2 are closed together tightly, the distance by which the arms B2, B2 approach each other increases with an increase in distance from the frame section 1, and as a result, the distance between the arms B2, B2 increases progressively toward the frame section 1 to be maximized at the base end portions of the arms B2, B2. Note that the distance between the base end portions of the arms B2, B2 becomes smaller when the arms B2, B2 are closed together compared to when they are not closed together.

The frame section 1 of the head B1 and the arms 2B, 2B are made of a thermoplastic resin material (for example, polypropylene or the like), and manufactured as a single injection molded product.

The configuration of the head B1 will be described in a greater detail.

In the following paragraphs, a space surrounded by the frame section 1 which in a plan view is circular is referred to as "central void V1" and a space formed between end portions of the frame section 1 is referred to as "arm-side void V2", as in FIG. 3B. The opening width of the arm-side void V2 is smaller than the diameter of the central void V1.

Figure 3A:
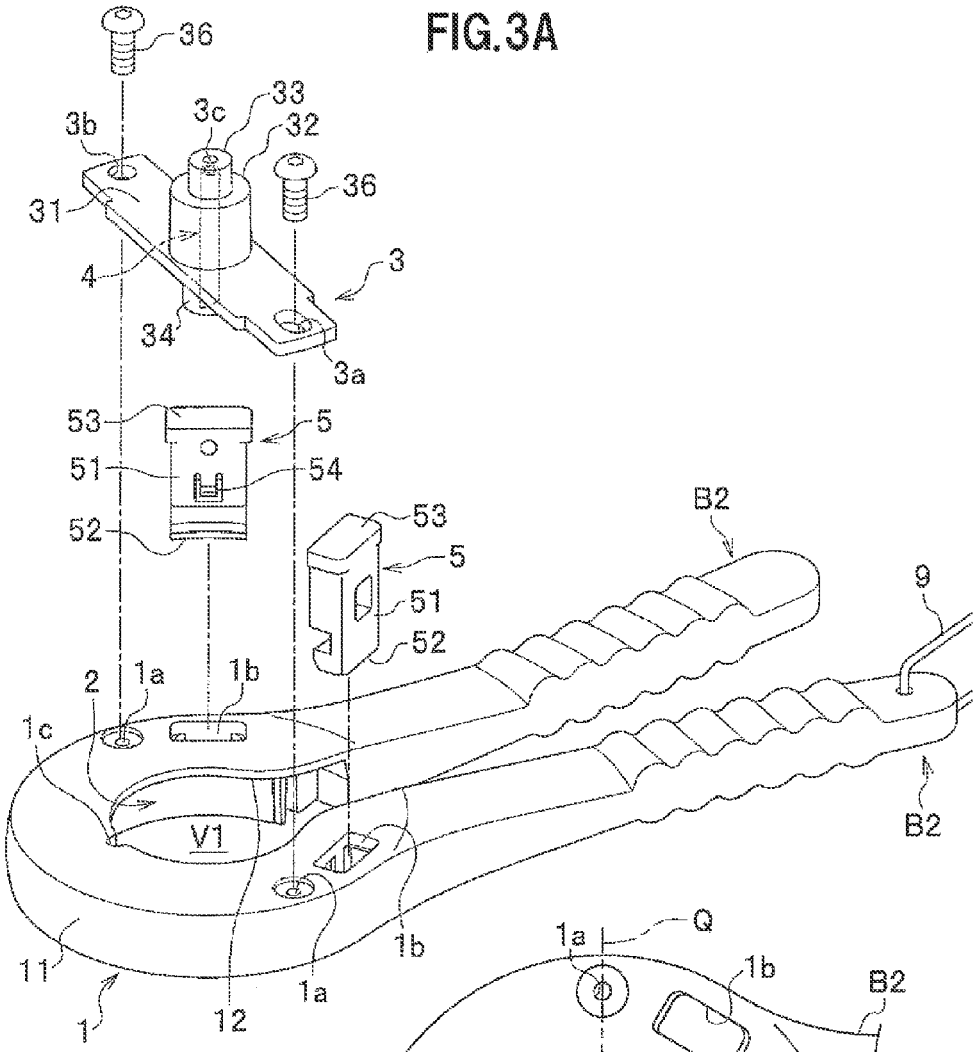
FIG. 3A is an exploded perspective view of a cap opener according to the embodiment of the present invention.

As shown in FIG. 3A, the frame section 1 is a section ranging from the base end of the first arm B1 to the base end of the second arm B2. The frame section 1 is curved to be C-shaped in a plan view and have opposite end portions (portions at which the frame section 1 adjoins to the arms B2, B2) located apart from each other.

The frame section 1 according to the embodiment includes an outer circumferential portion 11, an upper plate portion 12 extending inward in the radial direction of the outer circumferential portion 11, and a plurality of ribs 13, 13, . . . (see FIG. 4) extending from the outer circumferential portion 11 to the contact section 2. The outer circumferential portion 11 has a thickness (a height) equal to the thickness at the base ends of each of the arms B2. The upper plate portion 12 has a thickness smaller than the thickness at the base end of each of the arms B2. The outer circumferential edge of the outer circumferential portion 11 and the inner circumferential edge of the upper plate section 2 are each arc shaped. As shown in FIG. 4, the ribs 13 are formed between the first guide trenches 6, 6 and between the first guide trenches 6 and the second guide trenches 7.

When the arms B2, B2 are brought closer to each other, the diameter of the frame section 1 is reduced. When the arms B2, B2 are brought closer to each other by grasping tightly the handgrips of the arms B2, B2, the distance between the base end portions of the arms B2, B2 is decreased, making the opposite end portions of the frame section 1 closer to each other, reducing the diameter of the central void V (see FIG. 3B), and narrowing the opening width of the arm-side void V2 (see FIG. 3B). Note that by easing the force of tightly grasping the arms B2, B2, the frame section 1 also returns to the original state.

As shown in FIG. 3A, the frame section 1 is formed with tapped holes 1*a*, 1*a*, retention holes 1*b*, 1*b* and a notch 1*c*.

Figure 3B:
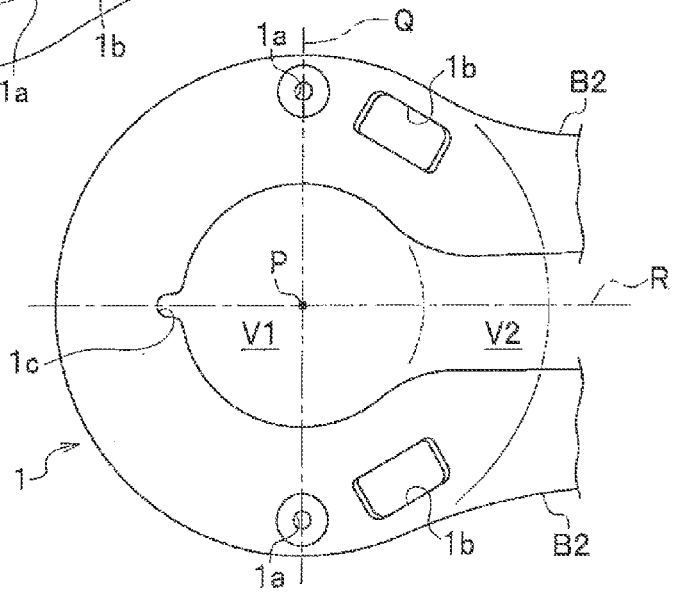
FIG. 3B is a top view of a frame section.

As shown in FIG. 3B, the tapped holes 1*a*, 1*a* are formed in areas opposite to each other across the central void V1. The centers of the tapped holes 1*a* are located at an outer edge portion of the frame section 1 and on a straight line Q passing through a center P of the central void V1.

The retention holes 1*b*, 1*b* are located in areas closer to the arms B2, B2 than the straight line Q. As shown in FIG. 4, both the retention holes 1*b*, 1*b* are formed in areas between the first guide trenches 6 and the second guide trenches 7. Each retention hole 1*b* is a cylindrical space that when viewed from above, is rectangular. Each retention hole 1*b* is open through the frame section 1 in the vertical direction thereof.

As shown in FIG. 3A, the notch 1*c* is a U-shaped cut, when viewed from above, that is formed in the inner circumferential edge of the upper plate section 12. As shown in FIG. 3B, the notch 1*c* is formed in an area opposite to the arm-side void V2 across the central void V1. The notch 1*c* is formed on a straight line passing through both the center P of the central void V1 and the middle point in the width direction of the arm-side void V2 (a central line between the arms B2, B2) R. Here, the straight line R is orthogonal to the straight line Q. By forming the notch 1*c*, the deformation resistance of the frame section 1 is reduced, which makes it easier to reduce the diameter of the frame section 1.

As shown in FIG. 4, the contact section 2 includes a support wall portion 21 that is supported by the frame section 1 and that when viewed from below is arc shaped; and a slip prevention portion 22 that covers the inner circumferential surface of the support wall portion 21. As shown in FIG. 6A, the contact section 2 has an inner diameter greater than the outer diameter of the screw cap C2 and smaller than the inner diameter of the guide sections A2 of the ring A.

Figure 5A:
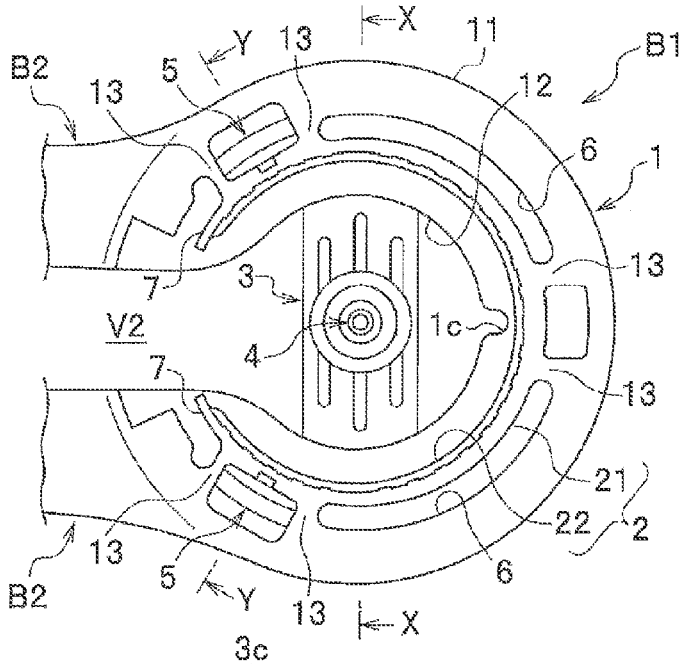
FIG. 5A is an enlarged view of a lower surface of a head.

As shown in FIG. 5A, the support wall portion 21 is located inside the outer circumferential portion 11. The support wall portion 21 is joined to the outer circumferential portion 11 via the plurality of ribs 13, 13, . . . . Also, the support wall portion 21 extends upright from the lower surface of the upper plate portion 12 (see FIGS. 5B and 5C). In other words, the support wall portion 21 has an outer circumferential surface and an upper end both joined to the frame section 1, so that the diameter of the support wall portion 21 is reduced with the reduction in the diameter of the frame section 1. Here, the support wall portion 21 is formed integrally with the frame section 1. Further, the support wall portion 21 has an inner circumferential surface formed with projections and recesses for enhancing bonding of the support wall portion 21 to the slip prevention portion 22.

The slip prevention portion 22 is a portion to contact the circumferential surface section C22 and is tightly attached to the inner circumferential surface of the support wall portion 21. The material for the slip prevention portion 22 is not limited, but preferably, it is such a material that makes it difficult for the screw cap C2 to slip on the slip prevention portion 22. According to the embodiment, the slip prevention portion 22 is formed of an elastomer (a thermoplastic resin) having a friction coefficient greater than that of a material that makes up the support wall portion 21.

In order to cover the support wall portion 21 with the slip prevention portion 22, an elastomer as a material for the slip prevention portion 22 is ejected onto the inner circumferential side of the support wall portion 21 after the fabrication of an injection-molded product that serves as the frame section 1 and the support wall portion 21 of the head B1 and the arms 2B, 2B. Incidentally, the slip prevention portion 22 may be formed by applying a material for the slip prevention portion 22 onto the inner circumferential surface of the support wall portion 21, or by fixing a strip-shaped rubber plate, etc., to the inner circumferential surface of the support wall portion 21 by an adhesive, screws, etc. or engagement.

The slip prevention portion 22, however, may be omitted. In the case where the slip prevention portion 22 is omitted, it is desirable to subject the inner circumferential surface of the support wall portion 21 to processing (such as embossing or knurling) to increase the friction coefficient thereof.

When the diameter of the frame section 1 is reduced, the contact section 2 according to the present embodiment is pressed against the circumferential surface section C22 (see FIG. 7A) of the screw cap C2. That is, by bringing the arms B2, B2 closer to each other, the diameter of the frame section 1 is reduced, decreasing the inner diameter of the contact section 2, and then by further tightening the arms B2, B2 with the contact section 2 in contact with the circumferential surface section C22, the inner circumferential surface of the contact section 2 is pressed against the circumferential surface section C22.

As shown in FIG. 3A, the top-surface facing section 3 includes a crossbar portion 31 secured to the frame section 1; a cylindrical accommodating portion 32 formed in the center of the crossbar portion 31; a needle fixing portion 33 formed on the cylindrical accommodating portion 32; a protection cover 34 fitted in the cylindrical accommodating portion 32; an urging means 35 (see FIG. 4) accommodated in the cylindrical accommodating portion 32; screws 36, 36 engaging the tapped holes 1*a*, 1*a* of the frame section 1; and spacers 37, 37 (see FIG. 5B) fitted around the necks of the screws 36. Of these components of the top-surface facing section 3, the crossbar portion 31, the cylindrical accommodating portion 32, and the needle fixing portion 33 are made of a thermoplastic resin (for example, propylene), and manufactured as a single injection molded product.

The crossbar portion 31 is disposed to bridge the central void V1 and fixed to the upper surface of the frame section 1 by the screws 36, 36. The crossbar portion 31 has opposite end portions formed with screw insertion holes 3*a*, 3*a*. One of the screw insertion holes 3*a* is elongate with its major axis aligned with a line connecting the tapping holes 1*a*, 1*a*. Namely, the screw insertion hole 3*a* is a slot (loose hole). As shown in FIG. 4, the crossbar portion 31 has a lower surface formed with reinforcing ribs 3*b*. The reinforcing ribs 3*e* reinforce the circumferential edge portion located around the opening of the cylindrical accommodating portion 32.

Figure 5B:
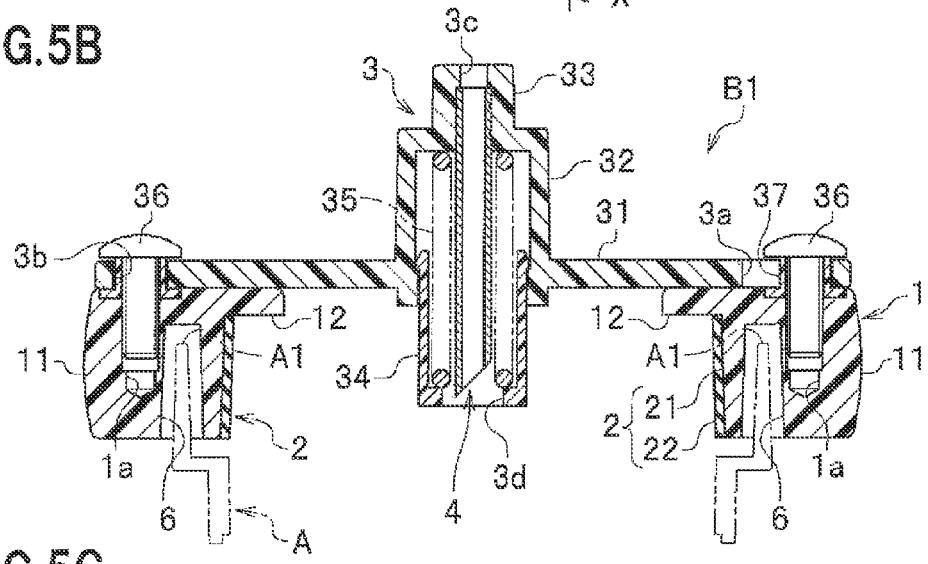
FIG. 5B is a cross sectional view taken along line X-X of FIG. 5A.

As shown in FIG. 5B, the cylindrical accommodating portion 32 has a lidded cylindrical shape open to the lower surface of the crossbar portion 31. The cylindrical accommodating portion 32 has an inner circumferential surface formed with a step at a lower end section thereof. The cylindrical accommodating portion 32 has a slightly smaller inner diameter at the step than at the higher section thereof.

The needle fixing portion 33 protrudes from the upper surface of the cylindrical accommodation portion 32. The needle fixing portion 33 has a through hole 3*c* formed at a center thereof. The through hole 3*c* extends vertically through the needle fixing portion 33.

The protection cover 34 is to sheath a needle 4 and has a bottomed cylindrical shape. The protection cover 34 has an outer circumferential surface formed with a pull-out stopper portion at an upper edge portion thereof for engagement with the step of the cylinder accommodation portion 32. The protection cover 34 has a needle insertion hole 3*d* formed at the bottom thereof. The protection cover 34, although retractable into the cylindrical accommodation portion 32, stays protruded beyond the cylindrical accommodation portion 32 (with the pull-out stopper portion of the protection cover 34 engaged with the step of the cylindrical accommodation portion 32) when there is no upward force applied to the protection cover 34 because the urging means 35 urges it downward.

The urging means 35 is provided between the lid portion of the cylindrical accommodation portion 32 and the bottom of the protection cover 34 for urging the protection cover 34 downward. There is no limitation with respect to the type of the urging means 35, but in the present embodiment, a coil spring is used.

The needle 4 is provided at the top-surface facing section 3. The needle 4 according to the present embodiment is a tubular member made of a metal (for example, a stainless steal, an aluminum alloy or the like) with its bottom end portion sharpened. The needle 4 has a top end portion fitted in the needle fixing portion 33 of the top-surface facing section 3. The needle 4 has a space in it that communicates with the through hole 3*c* of the needle fixing portion 33. The top end portion of the needle 4 is embedded into the needle fixing portion 33 either by press fitting or by insert molding. The lower end portion (sharpened portion) of the needle 4 protrudes beyond the lower surface of the crossbar portion 31. When there is no upward force applied to the protection cover 34, the lower end portion (sharpened portion) of the needle 4 is surrounded entirely by the protection cover 34 and never protrudes out of the protection cover 34.

Figure 5C:
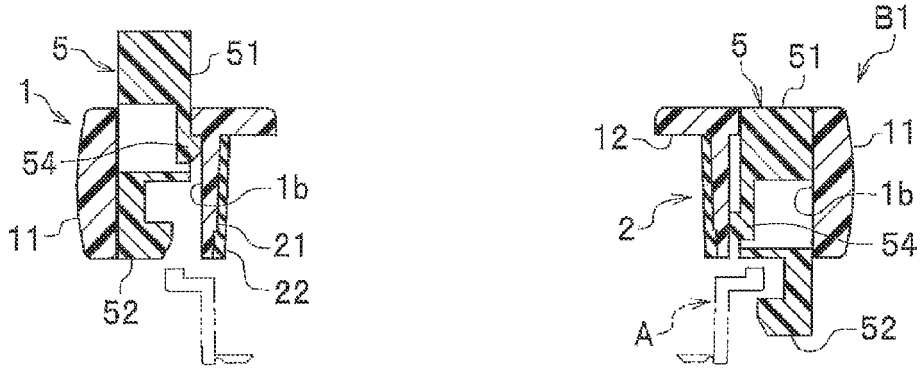
FIG. 5C is a cross sectional view taken along line Y-Y of FIG. 5A.

As shown in FIG. 3A, each hooking portion 5 includes a trunk portion 51 to be inserted in the retention hole 1*b* of the frame section 1 and a hook 52 located below the trunk portion 51. As shown in FIG. 5*c*, the hooking portion 5 is movable vertically. When the hooking portion 5 is moved to the uppermost position, the hook 52 is buried entirely in the retention hole 1*b* of the frame section 1. When the hooking portion 5 is moved downward, the hook 52 protrudes out of the retention hole 1*b*. The hooking portion 5 is made from a thermoplastic resin material (for example, polypropylene), and manufactured as a single injection molded product. Note that in FIG. 5*c*, illustration of the top-surface facing section 3 is omitted.

The trunk portion 51 is slidable within the retention hole 1*b*. The trunk portion 51 is formed with a retention hook 54. The retention hook 54 acts to block the hooking portion 5 from slipping out upward. When the hook 52 is pushed into the retention hole 1*b*, the retention hook 54 abuts against the edge around the opening of the retention hole 1*b* (see the left in FIG. 5C). The trunk portion 51 has an upper end portion formed with a flange 53, as shown in FIG. 3A. The flange 53 acts to block the hooking portion 5 from slipping out downward. When the trunk 51 is pushed into the retention hole 1*b*, the flange 53 abuts against the edge around the opening of the retention hole 1*b*.

The hook 52 is L-shaped (claw-like) in a cross sectional view, as shown in FIG. 5C. To make the hook 52 that is buried entirely in the retention hole 1*b* protrude out of it, the trunk portion 51 projecting beyond the upper surface of the frame section 1 is pushed into the retention hole 1*b*. To make the hook that protrudes out of the retention hole 1*b* buried entirely into the retention hole 1*b*, the hook 52 projecting beyond the lower surface of the frame section 1 is pushed into the retention hole 1*b*.

As shown in FIG. 5A, when viewed from below, the first guide trenches 6 are arc shaped spaces formed between the outer circumferential portion 11 and the support wall portion 21. As shown in FIG. 4, the two first guide trenches 6, 6 are arranged to correspond to two of the three guide sections A2, A2, A2 of the ring A. Each first guide trench 6 is shaped to accept one guide section A2. The arc of the first guide trench 6 has a radius approximately equal to the radius of the are of the guide section A2. Further, the first guide trench 6 has an arc length greater than that of the guide section A2 and a width greater than the thickness of the guide section A2.

The second guide trenches 7, 7 are spaces formed between the outer circumferential portion 11 and the support wall portion 21. As shown in FIG. 5B, the second guide trenches 7, 7 are located opposite to each other across the arm-side void V2 and communicate therewith. These two trenches 7, 7 are arranged to correspond to one of the three guide sections A2, A2, A2 (see FIG. 4) of the ring A. One second guide trench 7 is shaped to receive one end of the guide section A and the other second guide trench 7 is shaped to receive the other end of the guide section A that is inserted in the one second guide trench 7.

<How to Use Cap Opening Tool Set>

Description will be made of how to use the cap opening tool set.

In order for the user of the cap opener B (see FIG. 1) to remove the screw cap C2, the user first positions the head B1 over the screw cap C2 and the ring A, and then inserts the lower end portion of the contact section into a void V3 formed between the guide sections A2 and the screw cap C2, as shown in FIG. 6A. When the lower end portion enters the void V3, the needle 4 is positioned approximately at the center of the screw cap C2 and lateral movement of the head B1 is restricted. At this time, of the three guide sections A2, A2, A2 of the ring A, the upper end portions of two guide sections A2, A2 are within the first guide trenches 6, 6 and the upper end portion of the remaining one guide section A2 is within the second guide trenches 7, 7 (see FIG. 4).

Figure 6B:
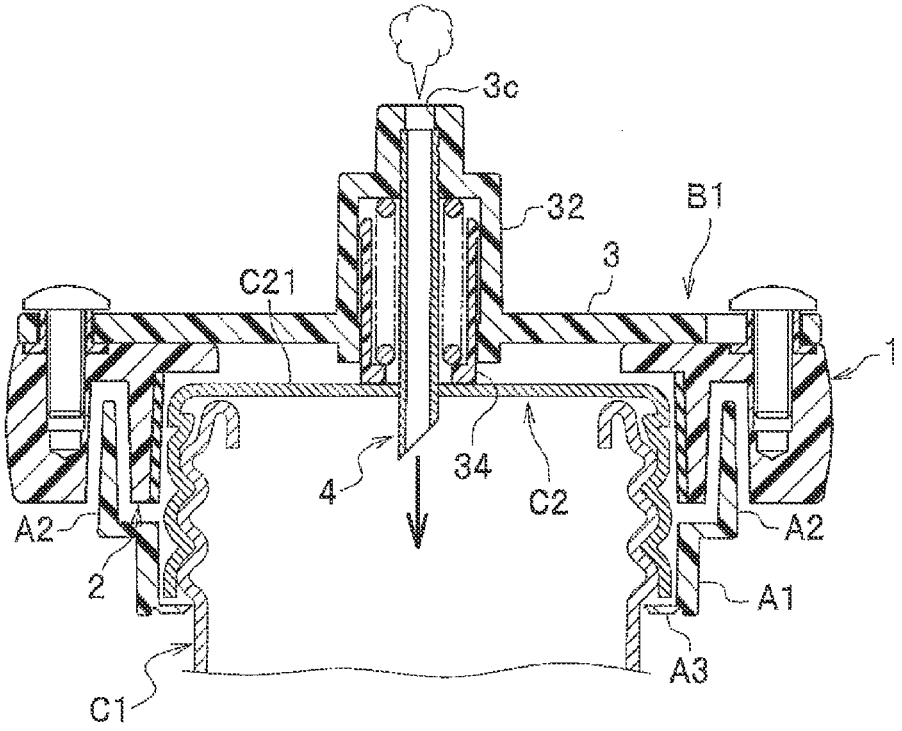

Then, the user applies a downward force to the head B1, which as shown in FIG. 6B, causes the head B1 to move downward and makes the needle 4 penetrate the top surface section C21. By the downward movement of the head B1, the contact section 2 proceeds further deep inside the void formed between the guide sections A2 and the screw cap C2 until major portions of the guide sections A2 are within the first guide trenches 6, 6 and the second guide trenches 7, 7, when the protection cover 34 is accommodated in the cylindrical accommodating portion.

When the needle 4 has penetrated the top surface section C21, the gas inside the container C1 escapes through the inside of the needle 4 and the through hole 3*c* to the outside to decrease the inner pressure of the container C1.

Figure 7A:
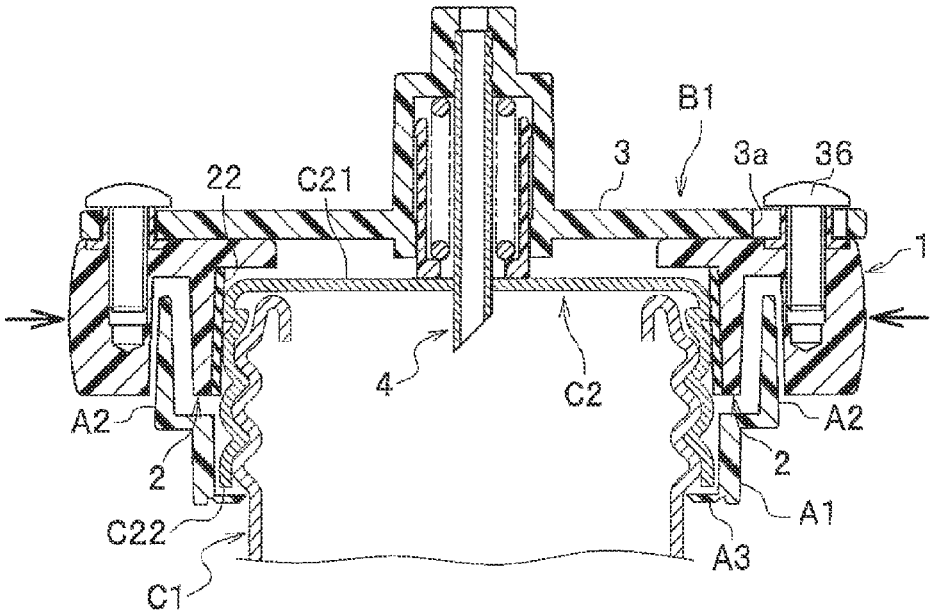
FIGS. 7A and 7B are cross sectional views for explaining a process of removing the screw cap, FIG. 7A illustrating a contact section pressing a circumferential surface section of the screw cap, FIG. 7B illustrating a state in which the crew cap is removed.
Figure 7B:
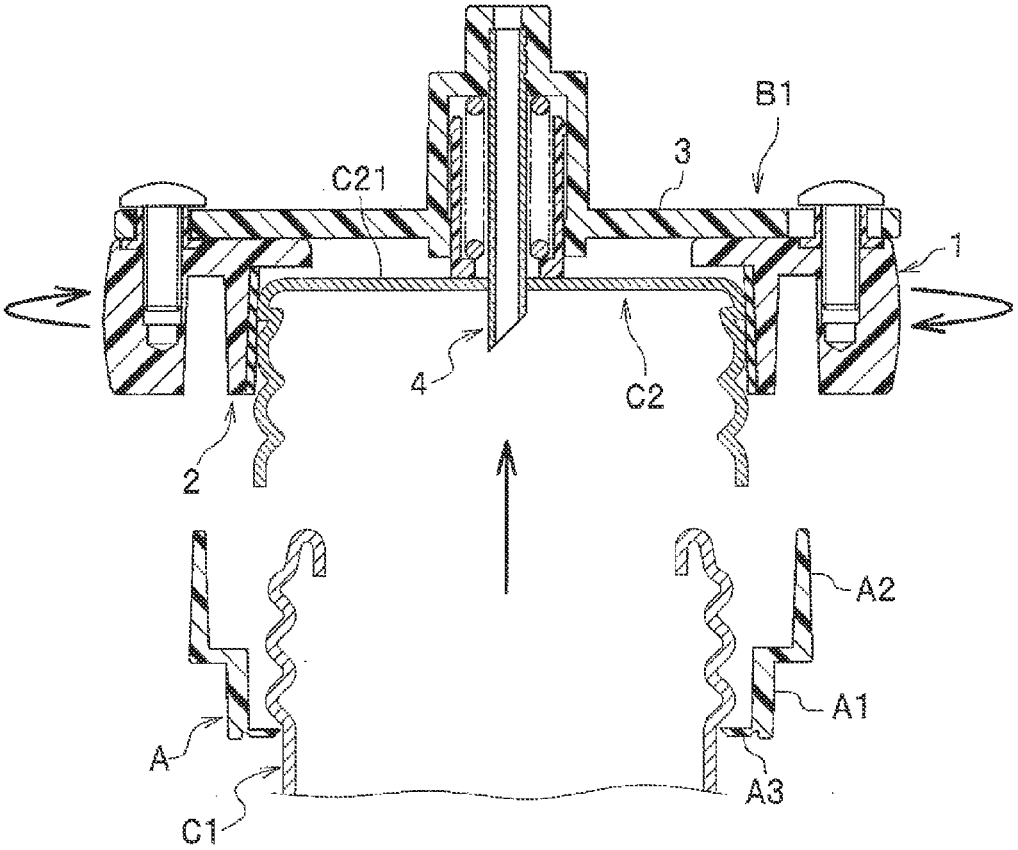

When the inner pressure of the container C1 has been released, the user, by grasping tightly and closing the arms B2, B2 (see FIG. 1) together by hand, decreases the diameter of the frame section 1, which causes decrease in the diameter of the contact section 2, which in turn, as shown in FIG. 7A, causes the slip prevention portion 22 of the contact section 2 to be pressed against the circumferential surface section C22 of the screw cap C2. Note that the top-surface facing section 3, although it is fixed to the frame section 1 by the screws 36, 36, will never prevent the decrease of the diameter of the frame section 1 because the screw 36 inserted in the loose hole (screw insertion hole 3*a*) shifts toward the center of the top-surface facing section 3.

Next, the user, while keeping the contact section 2 abutting against the circumferential surface section C22, rotates the arms B2, B2 (see FIG. 1) around the screw cap C2 to apply the rotation torque to the screw cap C2. To keep the contact section 2 abutting against the circumferential surface section C22, the user needs to continue grasping the arms B2, B2 (see FIG. 1) tightly or place the lock member 8*a* between the projections 8*b*, 8*b* while keeping the arms B2, B2 closer to each other.

If a rotation torque greater than a predetermined value is applied to the screw cap C2, the tightening of the screw cap C2 is loosened, which allows the user to remove the screw cap C2 from the container C1 easily. Here, since the guide sections A2 are within the first guide trenches 6, 6 and the second guide trenches 7, 7, the ring A rotates together with the head B1.

The ring A is provided for blocking the cap from being opened by any other means (such as another tool or a human hand) than the cap opener B, and is not needed any longer after the screw cap C2 is removed from the container C1.

Figure 8A:
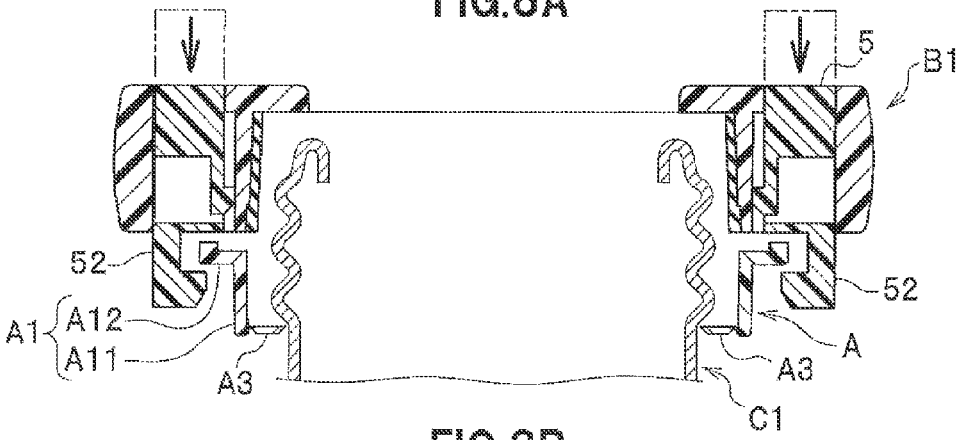
FIGS. 8A-8C are cross sectional views for explaining a process of removing the screw cap, FIG. 8A illustrating the head placed over the screw cap, FIG. 8B illustrating hooking portions latched on the ring, FIG. 8C illustrating a state in which the ring is removed.

In order for the user of the cap opener B (see FIG. 1) to remove the screw cap C2, first, the user places the head B1 over the ring A, as shown in FIG. 8A. The hooking portions 5, 5 are moved downward by the user before or after the head B is placed over the ring A. Note that in FIG. 8A, illustration of the top surface section 3 is omitted.

Figure 8B:
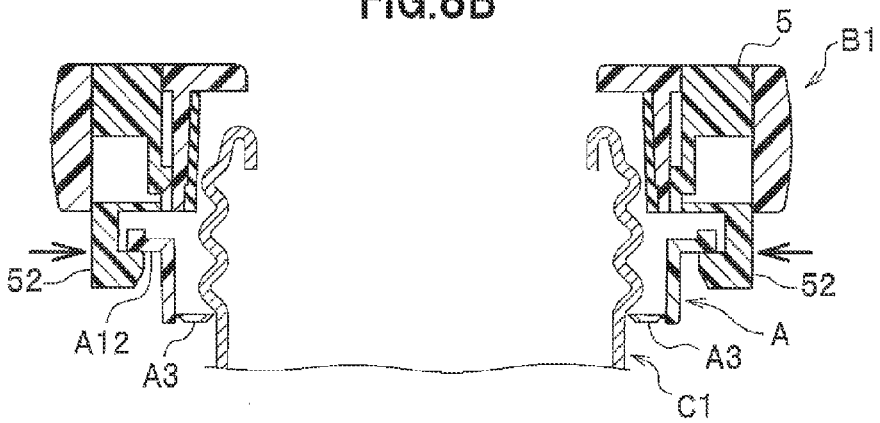
Figure 8C:
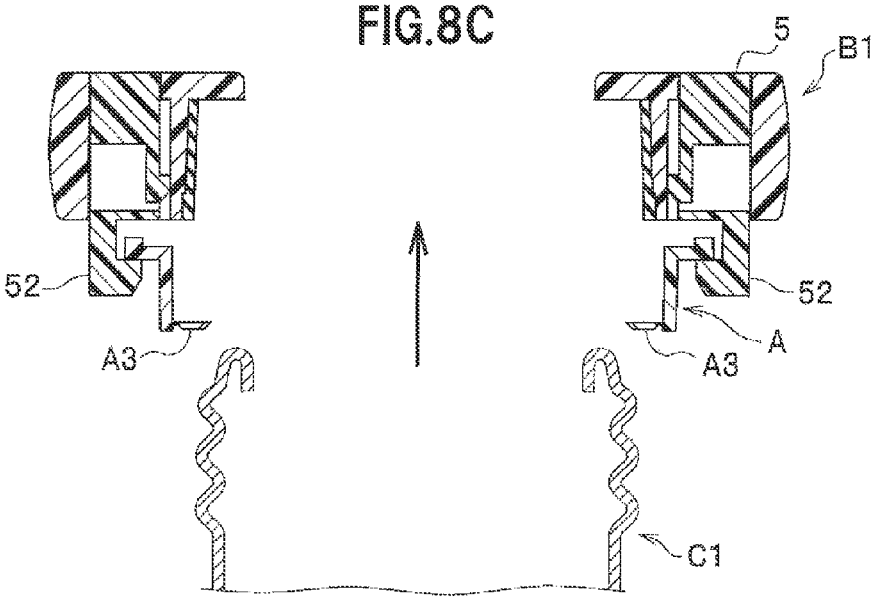

Subsequently, the user, grasping the arms B2, B2 (see FIG. 1) tightly, brings them closer to each other to reduce the diameter of the frame section 1, which causes the hooking portions 5, 5 to move toward the ring A, until the top ends of the hooks 52 of the hooking portions 5, 5 abut against the lower side of the flange A12 of the ring A (until the hooks 52 are latched and held on the ring A), as shown in FIG. 8B.

When the user tilts the arms B2, B2 while maintaining the above state, the extension sections A3, A3, A3 of the ring A are disengaged from the container C1, causing the ring A to come off the container C1.

As having been explained above, according to the cap opening tool set of the present embodiment, the user abandons opening the container C1 forcibly by any other means (such as another tool or a human hand) than the cap opener B. Namely, with the ring A fitted on the circumference of the screw cap C2, the screw cap C2 is difficult to grasp well by other tools or by hand, and thus, in order to apply a great rotation torque to the screw cap C2, the use of the cap opener B is encouraged, which prevents use of any other means than the cap opener B to open the container C1. According to the present embodiment, since the ring A is provided with the extension sections A3, A3, . . . , and these extension sections A3, A3 are constructed to engage the mouth section of the container C1, there is no possibility for the ring A to drop off from the container C1 unless the user deliberately attempts to remove the ring A.

According to the cap opener B of the present embodiment, the user only needs to penetrate the needle 4 through the top surface section C21 of the screw cap C2 to reduce the inner pressure of the container C1. Further, the contact section 2 enters the void formed between the guide sections A2, A2, A2 of the ring A and the screw cap C2, which makes it difficult for the head B1 to drop off from the screw cap C2 and also assists the user in pushing the needle 4 through the top surface section C21 of the screw cap C2 safely and smoothly. Further, by using the arms B2, B2, the location at which the user applies the rotation torque to the screw cap C2 becomes distant from the screw cap C2, making it possible for even a user with a weak arm power to loose loosen the screw cap C2 smoothly.

Moreover, according to the cap opener B of the present embodiment, the hooking portions 5, 5 can be latched and held on the outer circumferential surface of the ring A so that the user can easily remove the ring A when the ring A becomes out of use. The ability of the ring A to be removed from the container C1 improves ease of use of the container C1 after the container C1 is opened, and also makes the container C1, after use, more adapted to sorting and collection of waste, which leads to a contribution to effective utilization of resources (recycle and reuse).

According to the cap opener B of the present embodiment, the user only needs to grasp the pair of arms B2, B2 tightly to press the contact section 2 onto the screw cap C2. Namely, according to the cap opener B, the user only needs to bring the pair of arms B2, B2 closer to each other to generate a force to press the contact section 2 onto the screw cap C2, which eliminates the need to provide a clamping mechanism and thereby enables cost savings.

According to the present embodiment, an example is illustrated in which the ring A is fitted on the mouth section of the container C1. However, a ring may be fitted on the screw cap C2 to block the container from being opened by any other means than the cap opener B. Note that it is preferred that the ring be rotatable relative to the screw cap C2 because if the ring idly rotates, no rotation torque is applied to the screw cap C2 even if the user rotates the ring.

According to the present embodiment, an example is illustrated in which the cap opener B is used for the screw cap C2 on the container C1 fitted with the ring A. The cap opener B, however, may also be used even in a case where the container is without the ring A.

According to the present embodiment, an example is illustrated in which the contact section 2 of the head B1 is pressed onto the circumferential surface section C22 of the screw cap C2, to apply, by utilizing the friction force thus generated, a rotation torque to the screw cap C2. The contact section 2, however, may be constructed to engage the circumferential surface section C22 to apply a rotation torque to the screw cap C2. If for example, the circumferential surface section C22 of the screw cap C2 is formed with projections and recesses, the contact section 2 may be formed with projections and recesses to engage these projections and recesses. With this arrangement, the engagement of the projections and recesses formed on the circumferential surface section C22 of the screw cap C2 with those on the contact section 2 enables a rotation torque to be applied to the screw cap C2.

Moreover, according to the present embodiment, an example is illustrated in which by the pair of arms B2, B2, a force is generated that is used to press the contact section 2 onto the screw cap C2. However, the force may be generated by an unillustrated clamp or the like. In such a case, only one arm B2 may be provided.

EXPLANATION OF REFERENCE NUMERALS

A ring
A1 ring main body
A2 guide section
A3 extension section
B cap opener
B1 head
1 frame section
2 contact section
3 top-surface facing section
4 needle
5 hooking portion
B2 arm
C1 container
C2 screw cap
C21 top surface section
C22 circumferential surface section

The invention claimed is:

1. A cap opening tool set for use in removing a screw cap tightened on a mouth section of a container, the cap opening tool set comprising:

a ring constructed to be fitted on the container or on the screw cap; and a cap opener constructed to apply a rotation torque to the screw cap, the ring having a plurality of guide sections arranged at intervals from each other around the ring and facing a circumferential surface section of the screw cap, the cap opener including a head and at least one arm, the head constructed to be placed over the screw cap, the at least one arm extending from the head, the head including a frame section, a contact section formed on the frame section, a top-surface facing section, and a needle, the top-surface facing section constructed to face a top surface section of the screw cap, the needle disposed at the top-surface facing section, the frame section having a plurality of guide trenches in which the plurality of guide sections are able to be inserted, the contact section constructed to be inserted into a space between the screw cap and the plurality of the guide sections when the plurality of guide sections are inserted in the plurality of guide trenches, the contact section constructed to engage or press the circumferential surface section of the screw cap, and the needle constructed to penetrate the top surface section of the screw cap.

2. The cap opening tool set of claim 1, wherein the ring has an extension section extending inward in a radial direction thereof, the extension section constructed to engage the container or the screw cap.

3. The cap opening tool set of claim 2, wherein the cap opener has a hooking portion constructed to be latched and held on an outer circumference of the ring.

4. The cap opening tool set of claim 1, wherein the needle is constituted by a tubular member and has an inner space, the top-surface facing section has a needle fixing portion into which a top end portion of the needle is fitted and in which a through hole extends vertically through the needle fixing portion, and the through hole communicates with the inner space of the needle.

5. The cap opening tool set of claim 1, wherein the frame section is formed in a C-shape when viewed from above, the at least one arm comprises a pair of arms one of which is joined to one end portion of the frame section and the other of which is joined to the other end portion of the frame section, the frame section is constructed to reduce a diameter thereof as the pair of arms are brought closer to each other, and the contact section is constructed to be pressed against the circumferential surface section of the screw cap when the diameter of the frame section is reduced.

* * * * *